United States Patent [19]

Bildstein et al.

[11] 4,132,917

[45] Jan. 2, 1979

[54] ROTATING X-RAY TARGET AND METHOD FOR PREPARING SAME

[75] Inventors: Hubert Bildstein; Hubert Petter; Fritz Simader, all of Tyrol, Austria

[73] Assignee: Schwarzkopf Development Corporation, New York, N.Y.

[21] Appl. No.: 778,115

[22] Filed: Mar. 16, 1977

[30] Foreign Application Priority Data

Mar. 18, 1976 [AT] Austria ..... 2025/76

[51] Int. Cl.[2] ..... H01J 35/10

[52] U.S. Cl. ..... 313/330; 313/311

[58] Field of Search ..... 313/330, 311, 60

[56] References Cited

U.S. PATENT DOCUMENTS

| | | | |
|---|---|---|---|
| 3,158,513 | 11/1964 | Janssen et al. | 313/330 X |
| 3,579,022 | 5/1971 | Sedlatschek et al. | 313/330 |
| 3,683,223 | 9/1972 | Dietz | 313/330 X |
| 3,836,804 | 9/1974 | Frens et al. | 313/330 X |

*Primary Examiner*—Alfred E. Smith
*Assistant Examiner*—Charles F. Roberts
*Attorney, Agent, or Firm*—Morgan, Finnegan, Pine, Foley & Lee

[57] ABSTRACT

A rotating X-ray target comprised of a graphite body having brazed thereon a metal band focal track or layer in which the configuration of the surfaces of the graphite base and the metal layer corresponds to an annular segment of a spherical surface and method for preparing same.

10 Claims, 6 Drawing Figures

ROTATING X-RAY TARGET AND METHOD FOR PREPARING SAME

The present invention relates generally to a rotating X-ray target made of graphite having a metal surface layer in the area of the focal track which is composed preferably of a refractory metal. Central to this invention is the design arrangement for a rotating target. In particular, it is concerned with the bonding of a ring-shaped metal layer to the graphite body.

When X-rays are produced by bombarding refractory metals with electrons, about 99% of the electron energy is transformed into heat which must be conducted and radiated away. The output capacity of modern rotating targets is largely determined by the heat conduction and storage capacity and, above all, the heat radiating properties of the target material.

Accordingly, it has been proposed to use graphite as a base material because of its excellent thermal properties and to cover the target in the focal track area with a refractory metal or alloy thereof, preferably a tungsten-rhenium alloy. In principle, there are two ways of applying the metal layer. The metal is either deposited by known methods such as plasma spraying, electrolysis or gas phase deposition on the graphite surface, or the focal track in the form of an annular metal band is brazed on the graphite body.

Neither of the two methods of applying the metal layer has so far fulfilled all the requirements for a rotating target in a fully satisfactory manner. With the coating methods, problems are encountered with coating adhesion, porosity of the coating and, particularly, with undesirable carburizing reactions in the boundary region between graphite and metal.

The difficulties inherent in the brazing method are twofold. The first relates to the choice of a suitable braze. In the second, it is not usually possible to obtain a sufficiently reliable fit of the parts to be joined which ensures that all areas are uniformly brazed. A slight but highly deleterious tilt of the faces in relation to each other usually remained unnoticed because the prevailingly preferred surface shape of the focal track corresponds to the mantle of a very flat frustrated cone to obtain maximum X-ray yield. Cavities are formed in the braze which are usually not detectable from the external appearance of the target, which result in local overheating of the ring during operation and increasing tendency of the ring to be detached from the graphite base.

The above problems which this invention overcomes resides in design measures to ensure that the surfaces of the metal ring and the graphite body which are to be joined by brazing thereby forming the target, always form plane abutting surfaces resulting in a uniform brazed joint.

According to this invention, the surfaces of the graphite body and the metal band which are to be joined by brazing, have a form corresponding to an annular segment of a spherical surface.

The spherical surface can be achieved on the graphite body, for example, by turning or grinding.

Any metal or alloy suitable for the generation of X-rays, especially refractory metals and their alloys, may be used as material for the ring. It has been found advantageous to form the annular metal ring of several layers, for example, a first molybdenum layer adjoining the graphite body, and a superposed tungsten-rhenium layer.

The metal ring can be manufactured as a shaped body using known methods of powder metallurgy. The spherical surface to be brazed is preferably generated by turning or grinding, or by a finishing treatment.

The metal ring may also be made of a metal band produced by melting or sintering. In the case of refractory metals, the rough shape is obtained by hot deformation, for example, hot forging. The precise spherical shape is then imparted to the ring by machining.

The spherical surfaces have a relatively slight curvature. The ratio of the radius of the spherical surface to be brazed to the rotating target radius is preferably in the range of 2:1 to 8:1.

The spherical surfaces can be curved either in such a way that the metal ring is concave and the graphite body convex or, vice versa, i.e. the ring being convex and the graphite body concave. The latter arrangement has the advantage in that the metal ring has its maximum thickness in the area of the focal track and thus need not have the overall thickness as in the former case. These considerations are particularly important when expensive metals such as a tungsten-rhenium alloy, are used to form the metal ring.

In accordance with the invention, the brazed surface has the advantage when compared to previously used brazed frustrated cone surfaces in that it possesses a spherical symmetry so that it can be superposed and brazed without the risk of tilting and formation of cavities. It has also been found advantageous to make the width of the spherical surface on the graphite body slightly greater than that of the metal ring.

The invention is more fully described in connection with the annexed drawings in which.

Figure 1:
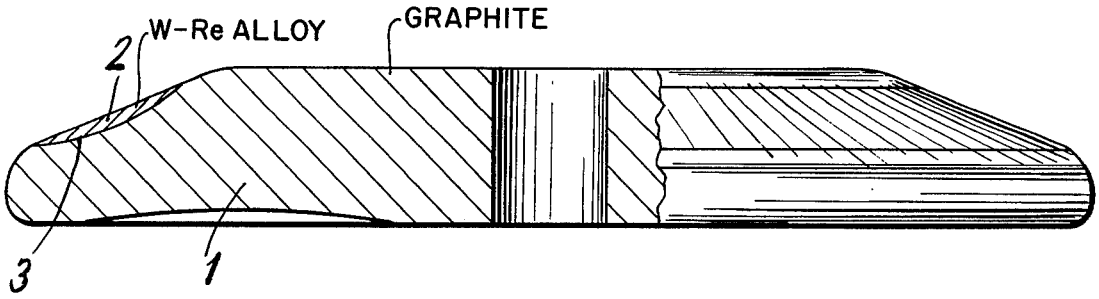
FIG. 1 is a section of the rotating target of this invention.

In FIG. 1, focal track 2 having a focal track surface 4 representing the mantle surface of a flat frustrated cone is made of a refractory metal or alloy thereof, and body 1 is made of graphite. Brazed surface 3 is concave with respect to graphite body 1 and convex with respect to focal track 2.

Figure 2:
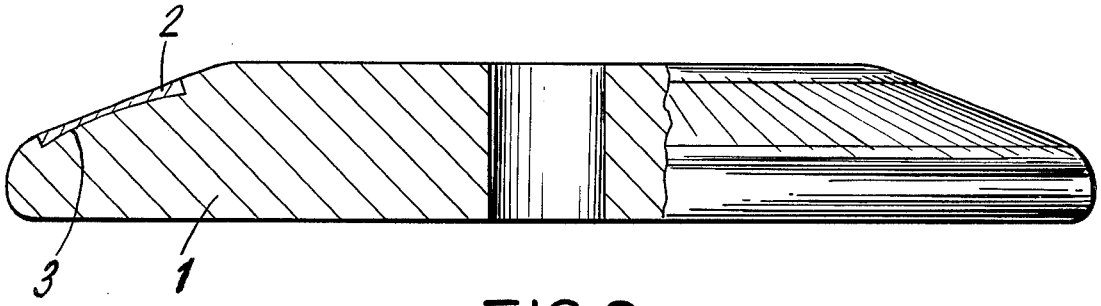
FIG. 2 is a section of another embodiment of this invention.

FIG. 2 differs from FIG. 1 in that brazed surface **3*a* is convex with respect to graphite body 1 and concave with respect to focal track 2*a*, said focal track having a surface 4*a*** representing the mantle surface of a flat frustrated cone.

Figure 3:
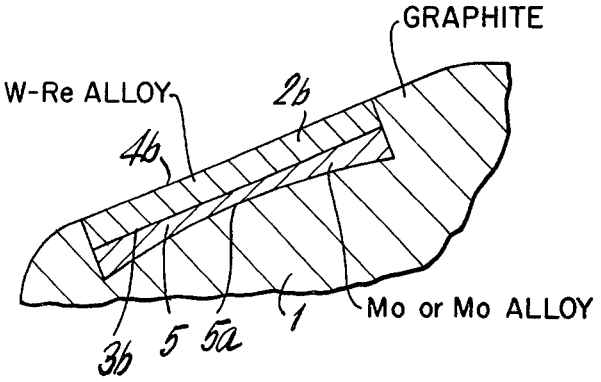
FIG. 3 is a partial section of another embodiment of this invention.

In FIG. 3, a focal track having a focal track surface **4*b* representing the mantle surface of a flat frustrated cone is comprised of first layer 5 composed of molybdenum or a molybdenum alloy contiguous with graphite body 1 and second superimposed layer 2*b* composed of a tungsten-rhenium alloy. Boundary 3*b* separating layers 2*b* and 5 has a surface substantially parallel in relation to focal track surface 4*b*. Brazed surface 5*a* is convex with respect to graphite body 1 and concave with respect to focal track 4*b***.

Figure 4:
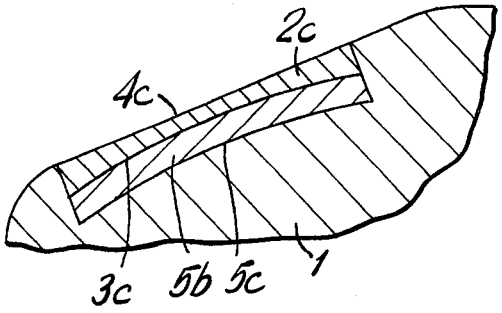
FIG. 4 is a partial section of another embodiment of this invention.

FIG. 4 differs from FIG. 3 in that boundary 3*c* separating layers 2*c* and 5*b* has a surface substantially parallel in relation to brazed surface 5*c*.

Figure 5:
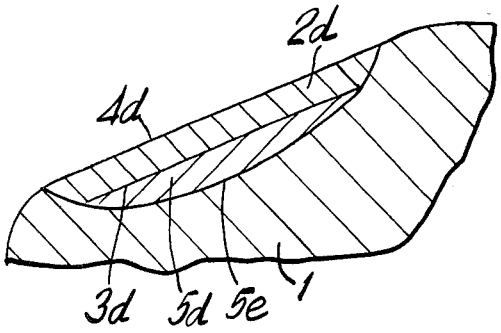
FIG. 5 is a partial section of another embodiment of this invention.

In FIG. 5, a focal track having a focal track surface 4*d* is comprised of first layer 5*d* composed of molybdenum or a molybdenum alloy contiguous with graphite body 1 and second superimposed layer 2*d* composed of a tungsten-rhenium alloy. Boundary 3*d* separating layers 2*d* and 5*d* has a surface substantially parallel in relation to focal track surface 4*d*. Brazed surface 5*e* is concave with respect to graphite body 1 and convex with respect to focal track 4*d*.

Figure 6:
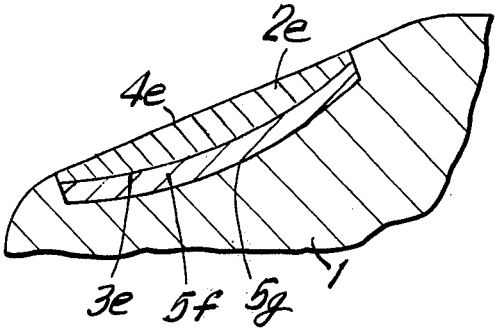
FIG. 6 is a partial section of another embodiment of this invention.

FIG. 6 differs from FIG. 5 in that boundary 3*e* separating layers 2*e* and 5*f* has a surface substantially parallel in relation to brazed surface 5*g*.

According to a preferred embodiment of the invention, the graphite target has a discus shape with a target radius of 55 mm and a maximum thickness of 40 mm. The annular segment, 25 mm in width, is concave and has an inner ring radius of 25 mm. The radius of the spherical surface is 200 mm.

The preshaped metallic ring body made by a powder metallurgical process consists of a tungsten alloy with 5 weight-% rhenium. The brazed area is given the exact spherical shape by machining. Prior to brazing, a coating of titanium carbide about 10 mm in thickness, is applied by chemical vapor deposition on the brazing area of the graphite body. This serves to close residual pores in the graphite surface and to prevent undesirable carbide formation in the joint. The braze consists of titanium or zirconium foil or powder paste which is inserted between the surfaces to be brazed. The brazing operation is carried out for about 1 hour at 1680° C. under a vacuum of under $10^{-4}$ Torr.

After brazing, the surface of the metal ring is finish-ground to its final form, corresponding to the mantle of a first frustrated cone.

The invention is not limited to the above-described embodiments. It is generally applicable to all rotating graphite target designs in which the boundary between the graphite base and the metal layer has the shape of a spherical segment.

What is claimed is:

1. A rotating X-ray target comprised of a graphite body having brazed thereon a single- or multi-layer metal band focal track, the focal track surface representing the mantle surface of a flat frustrated cone, the improvement wherein the brazed surfaces of said graphite body and said metal band focal track have a configuration corresponding to an annular segment of a spherical surface.

2. The rotating X-ray target of claim 1 wherein the brazed graphite surface is concave and the corresponding surface of the metal band focal track is convex.

3. The rotating X-ray target of claim 1 wherein the brazed graphite surface is convex and the corresponding surface of the metal band focal track in concave.

4. The rotating X-ray target of claim 1 wherein the ratio of the radius of the brazed spherical surface to the radius of said rotating target is between 2:1 and 8:1.

5. The rotating X-ray target of claim 1 wherein the metal band focal track is made of a refractory metal or a refractory metal alloy.

6. The rotating X-ray target of claim 5 wherein the metal band focal track is made of a tungsten-rhenium alloy.

7. The rotating X-ray target of claim 1 wherein the metal band focal track consists of a first layer made of molybdenum or a molybdenum alloy contiguous with the graphite body, and a second superposed tungsten-rhenium alloy layer.

8. In a method for the production of the rotating X-ray target of claim 1 wherein the preshaped metal band focal track is manufactured by powder metallurgical procedures.

9. In a method for the production of the rotating X-ray target of claim 1 wherein the metal band focal track is shaped by hot deformation of a blank made by melting or sintering and then finished to the desired spherical shape by machining.

10. In a method for the production of the rotating X-ray target of claim 1 wherein the frustrated cone surface of the metal band focal track is produced after brazing by a grinding process.

* * * * *